US010760452B2

(12) United States Patent
Hotta et al.

(10) Patent No.: US 10,760,452 B2
(45) Date of Patent: Sep. 1, 2020

(54) CONDENSER AND STEAM TURBINE PLANT PROVIDED WITH SAME

(71) Applicant: Mitsubishi Hitachi Power Systems, Ltd., Kanagawa (JP)

(72) Inventors: Katsuhiro Hotta, Yokohama (JP); Taichi Nakamura, Yokohama (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 19 days.

(21) Appl. No.: 15/999,818

(22) PCT Filed: Feb. 24, 2017

(86) PCT No.: PCT/JP2017/007100
§ 371 (c)(1),
(2) Date: Aug. 20, 2018

(87) PCT Pub. No.: WO2017/146209
PCT Pub. Date: Aug. 31, 2017

(65) Prior Publication Data

US 2019/0331005 A1 Oct. 31, 2019

(30) Foreign Application Priority Data

Feb. 25, 2016 (JP) ..... 2016-034231

(51) Int. Cl.
*F01K 9/02* (2006.01)
*F01D 25/30* (2006.01)
(Continued)

(52) U.S. Cl.
CPC ..... *F01K 9/02* (2013.01); *F01D 25/30* (2013.01); *F28B 1/02* (2013.01); *F28B 9/02* (2013.01)

(58) Field of Classification Search
CPC ..... F01D 25/30; F01K 23/02; F01K 23/04; F28B 1/02; F28B 9/02
See application file for complete search history.

(56) References Cited

U.S. PATENT DOCUMENTS 2,939,685 A 6/1960 Worn et al.
5,497,624 A * 3/1996 Amir ..... F01D 15/10 60/641.5
(Continued)

FOREIGN PATENT DOCUMENTS

DE 1 501 339 12/1969
GB 190907321 6/1910
(Continued)

OTHER PUBLICATIONS

JP2014066390 machine translation (Year: 2014).*
(Continued)

*Primary Examiner* — Gordon A Jones
(74) *Attorney, Agent, or Firm* — Wenderoth, Lind & Ponack, L.L.P.

(57) ABSTRACT

A condenser includes heat transfer pipe groups, a main body and an intermediate body. The intermediate body has an inlet that opens in a horizontal direction, and an outlet that opens downward. The main body has an inlet that opens upward and is connected to the intermediate body outlet. The heat transfer pipe groups are arranged in the horizontal direction and disposed in the main body. A near-side outlet edge is an edge of the intermediate body outlet on a side near the intermediate body inlet in the horizontal direction and a far-side outlet edge is an edge of the intermediate body outlet on a side far from the intermediate body inlet. At least one part of the main body is located below an imaginary line
(Continued)

that connects the near-side and far-side outlet edges and at least one part of the main body is located above the imaginary line.

12 Claims, 8 Drawing Sheets

(51) Int. Cl.
*F28B 1/02* (2006.01)
*F28B 9/02* (2006.01)

(56) References Cited

U.S. PATENT DOCUMENTS

| | | | | |
|---|---|---|---|---|
| 5,941,301 | A * | 8/1999 | Baumann | F28B 9/10 165/113 |
| 8,157,898 | B2 * | 4/2012 | Fujita | F28B 1/02 165/113 |
| 9,708,936 | B2 * | 7/2017 | Nagai | F01K 9/00 |
| 2001/0011458 | A1 * | 8/2001 | Koronya | F28B 1/02 60/643 |
| 2010/0300101 | A1 | 12/2010 | Swintek et al. | |
| 2016/0017756 | A1 * | 1/2016 | Hotta | F01K 9/003 60/660 |

FOREIGN PATENT DOCUMENTS

| | | | |
|---|---|---|---|
| GB | 215356 | | 7/1925 |
| JP | 51-137008 | | 11/1976 |
| JP | 9-273875 | | 10/1997 |
| JP | 2003-302175 | | 10/2003 |
| JP | 2010-276020 | | 12/2010 |
| JP | 2014-66390 | | 4/2014 |
| JP | 2016-109400 | | 6/2016 |
| WO | WO-2014156686 | A1 * | 10/2014 |

OTHER PUBLICATIONS

International Search Report dated Apr. 11, 2017 in International Application No. PCT/JP2017/007100.

Written Opinion of the International Searching Authority dated Apr. 11, 2017 in International Application No. PCT/JP2017/007100 (with English translation).

International Search Report dated Oct. 18, 2016 in International Application No. PCT/JP2016/072623.

Written Opinion of the International Searching Authority dated Oct. 18, 2016 in International Application No. PCT/JP2016/072623 (with English translation).

* cited by examiner

CONDENSER AND STEAM TURBINE PLANT PROVIDED WITH SAME

TECHNICAL FIELD

The present invention relates to a condenser configured to condense steam exhausted from a steam turbine, and a steam turbine plant including the same.

Priority is claimed on Japanese Patent Application No. 2016-034231, filed Feb. 25, 2016, and PCT International Application No. PCT/JP2016/072623, filed Aug. 2, 2016, the contents of which are incorporated herein by reference.

BACKGROUND ART

A steam turbine plant includes a steam turbine driven by steam, and a condenser configured to condense the steam exhausted from the steam turbine and return the steam into water.

As such a steam turbine plant, for example, a steam turbine plant is disclosed in the following Patent Literature 1. The steam turbine plant includes an axial-flow exhaust type steam turbine, and a condenser configured to return steam exhausted from the steam turbine into water. The condenser includes a plurality of heat transfer pipe groups, a main body configured to cover the plurality of heat transfer pipe groups, and an intermediate body configured to guide steam from the steam turbine into the main body.

The intermediate body is formed in a tubular shape using a virtual axis that is substantially horizontal as a center. An intermediate body inlet is formed on one end of the intermediate body having a tubular shape, and an intermediate body outlet is formed on the other end. The steam from the steam turbine flows into the intermediate body from the intermediate body inlet. The main body has a bottom plate, a plurality of side plates extending upward from an edge of the bottom plate, and a top plate. A main body inlet is formed in the side plate of the main body on the side of the steam turbine. Steam from the intermediate body flows into the main body from the main body inlet. In other words, steam flows into the main body from a substantially horizontal direction. A plurality of heat transfer pipe groups arranged in a horizontal direction and a plurality of heat transfer pipe groups arranged in a vertical direction are disposed in the main body.

CITATION LIST

Patent Literature

[Patent Literature 1]

Japanese Unexamined Patent Application, First Publication No. H09-273875

SUMMARY OF INVENTION

Technical Problem

As described above, the condenser disclosed in Patent Literature 1 has the plurality of heat transfer pipe groups arranged in the vertical direction. For this reason, a cooling water pump configured to supply cooling water to a plurality of heat transfer pipes that constitute the heat transfer pipe groups is required to have a capability of supplying the cooling water to the heat transfer pipe disposed on the uppermost section in the heat transfer pipe group located furthest upward. Accordingly, in the technology disclosed in Patent Literature 1, a cooling water pump having a high pumping head is required, and thus initial cost and running cost increase.

Here, the present invention is directed to providing a condenser capable of reducing initial cost and running cost, and a steam turbine plant including the same.

Solution to Problem

In order to accomplish the above-mentioned object, a condenser of a first aspect of the present invention includes: a plurality of heat transfer pipe groups constituted by a plurality of heat transfer pipes through which cooling water that exchanges heat with steam passes; a main body configured to cover the plurality of heat transfer pipe groups; and an intermediate body connected to the main body and configured to guide steam into the main body. The intermediate body has an intermediate body inlet that opens from the inside in a horizontal direction and into which steam flows, an intermediate body outlet that opens downward from the inside and through which steam is exhausted, and a flow path configured to connect the intermediate body inlet and the intermediate body outlet and cause the steam flowing in from the intermediate body inlet to be directed gradually downward as it flows away from the intermediate body inlet in the horizontal direction to reach the intermediate body outlet. The main body has a main body inlet that opens upward from the inside and is connected to the intermediate body outlet, and into which the steam from the intermediate body flows. The plurality of heat transfer pipe groups are arranged in the horizontal direction and disposed in the main body. A near-side outlet edge that is an edge of the intermediate body outlet on a side near the intermediate body inlet in the horizontal direction is disposed below the uppermost position among the plurality of heat transfer pipe groups.

In the condenser, since the plurality of heat transfer pipe groups are arranged in the horizontal direction and disposed in the main body, a level difference between the uppermost position among the plurality of heat transfer pipe groups and a water source of the cooling water supplied to the heat transfer pipe group can be reduced. Accordingly, in the condenser, a pumping head of a cooling water pump configured to supply the cooling water from the water source to the heat transfer pipe can be reduced. For this reason, the condenser can reduce installation cost and running cost of the cooling water pump.

Further, in the condenser, the near-side outlet edge of the intermediate body outlet is disposed below the uppermost position among the plurality of heat transfer pipe groups. For this reason, in the condenser, an installation position of the steam turbine connected to the condenser can be lowered. Accordingly, in the condenser, installation cost of the steam turbine can be reduced.

According to a condenser of a second aspect, in the condenser of the first aspect, a near-side inner surface including the near-side outlet edge that is an inner surface of the intermediate body that forms the flow path of the intermediate body is a surface directed toward the side near the intermediate body inlet while being directed upward from the near-side outlet edge.

In the condenser, a flow path area of the flow path on the side of the intermediate body outlet in the flow path of the intermediate body can be increased. For this reason, in the condenser, it is considered possible to reduce an average flow speed of the steam flowing into the heat transfer pipe group and provide a certain effect of suppressing erosion in the heat transfer pipe.

According to a condenser of a third aspect, in the condenser of the first or second aspect, a far-side outlet edge that is an edge of the intermediate body outlet on a side far from the intermediate body inlet in the horizontal direction is disposed above the uppermost position among the plurality of heat transfer pipe groups.

In the condenser, the intermediate body outlet edge is inclined from the far-side outlet edge toward the near-side outlet edge. Accordingly, in the condenser, an opening area of the intermediate body outlet can be increased. For this reason, in the condenser, it is considered possible to reduce an average flow speed of the steam flowing into the heat transfer pipe group and provide a certain effect of suppressing erosion in the heat transfer pipe.

In addition, according to a condenser of a fourth aspect, in the condenser according to any one of the first to third aspects, the plurality of heat transfer pipe groups are disposed at positions below a lower end of the intermediate body inlet in the main body.

In the condenser, since the steam that flows straight from the steam turbine in the horizontal direction does not directly flow into the heat transfer pipe group, a certain effect of suppressing erosion in the heat transfer pipe is considered to be provided.

In addition, according to a condenser of a fifth aspect, in the condenser according to any one of the first to fourth aspects, a dimension in a vertical direction of a pipe group outline formed by virtual surfaces that circumscribe the plurality of heat transfer pipes disposed on the outermost side among the plurality of heat transfer pipes that constitute the heat transfer pipe group is larger than a dimension of the pipe group outline in the horizontal direction.

In the condenser, the bottom surface of the pipe group outline can be reduced. For this reason, in the condenser, even when the plurality of heat transfer pipe groups are disposed to be arranged in the main body in the horizontal direction, an increase in occupation area of the condenser can be minimized.

According to a condenser of a sixth aspect, in the condenser of the fifth aspect, the pipe group outline has an upper surface directed upward and a bottom surface directed downward, and an upper section including the upper surface in the pipe group outline has a cross-sectional area in the horizontal direction that is gradually increased downward.

The steam passing through the intermediate body flows into the main body from the main body inlet. The steam flows mainly downward through the main body. The steam exchanges heat with the cooling water flowing through the plurality of heat transfer pipes that constitute each of the heat transfer pipe groups while flowing through the main body.

When the steam flows downward through the main body, as an area of the upper surface of the pipe group outline facing the flow is increased, the efficiency of heat exchange between the steam and the cooling water in the heat transfer pipes that constitute the heat transfer pipe group is increased. In the condenser, since a part of the upper surface of the pipe group outline is an inclined surface, an area of the upper surface can be increased more than when the entire upper surface is a horizontal surface. Accordingly, in the condenser, the efficiency of heat exchange between the steam and the cooling water in the heat transfer pipes that constitute the heat transfer pipe group can be increased more than when the entire upper surface of the pipe group outline is a horizontal surface.

According to a condenser of a seventh aspect, in the condenser of the sixth aspect, the pipe group outline of at least one of the heat transfer pipe groups is an eccentric outline in which a center of a top surface at the uppermost position in the upper surface is disposed closer to the intermediate body inlet in the horizontal direction than a center of the bottom surface in the same pipe group outline.

In the condenser, even when a ratio of the horizontal component in the flow direction component of the steam flowing into one of the heat transfer pipe groups is large, the efficiency of heat exchange between the steam and the cooling water in the heat transfer pipes that constitute one of the heat transfer pipe groups can be increased.

According to a condenser of an eighth aspect, in the condenser of the seventh aspect, the plurality of heat transfer pipe groups are arranged in a far side-near side direction with respect to the intermediate body inlet that is the horizontal direction, and the pipe group outline of the heat transfer pipe group closest to the intermediate body inlet in the far side-near side direction among the plurality of heat transfer pipe groups is the eccentric outline.

A flow direction component of the steam flowing into the heat transfer pipe group closest to the intermediate body inlet in the far side-near side direction has a ratio of the horizontal component that is larger than that of the flow direction component of the steam flowing into another heat transfer pipe group. Accordingly, since the pipe group outline of the heat transfer pipe group closest to the intermediate body inlet in the far side-near side direction has an eccentric outline, the efficiency of heat exchange with the cooling water in the heat transfer pipes that constitute the heat transfer pipe group can be increased.

According to a condenser of a ninth aspect, the condenser of the fifth or sixth aspect further includes a steam guide disposed in the intermediate body and causing a direction of a flow of the steam flowing in from the intermediate body inlet to be directed gradually downward.

In the condenser, a downward component in the flow direction component of the steam flowing into the plurality of heat transfer pipe groups can be increased. For this reason, in the condenser, the efficiency of heat exchange between the steam and the cooling water in the heat transfer pipes that constitute the heat transfer pipe groups can be increased.

In order to accomplish the above-mentioned object, a steam turbine plant of a tenth aspect according to the present invention includes the condenser according to any one of the first to ninth aspects, and a steam turbine configured to exhaust the steam into the condenser.

According to a steam turbine plant of an eleventh aspect, in the steam turbine plant of the tenth aspect, the steam turbine is an axial-flow exhaust type steam turbine.

According to a steam turbine plant of a twelfth aspect, in the steam turbine plant of the tenth aspect, the steam turbine is a lateral exhaust type steam turbine.

Advantageous Effects of Invention

According to an aspect of the present invention, it is possible to reduce initial cost and running cost of a steam turbine plant.

DESCRIPTION OF EMBODIMENTS

Hereinafter, various embodiments and various variants of a steam turbine plant according to the present invention will be described with reference to the accompanying drawings.

First Embodiment

A first embodiment of the steam turbine plant according to the present invention will be described with reference to FIGS. 1 to 3.

Figure 1:
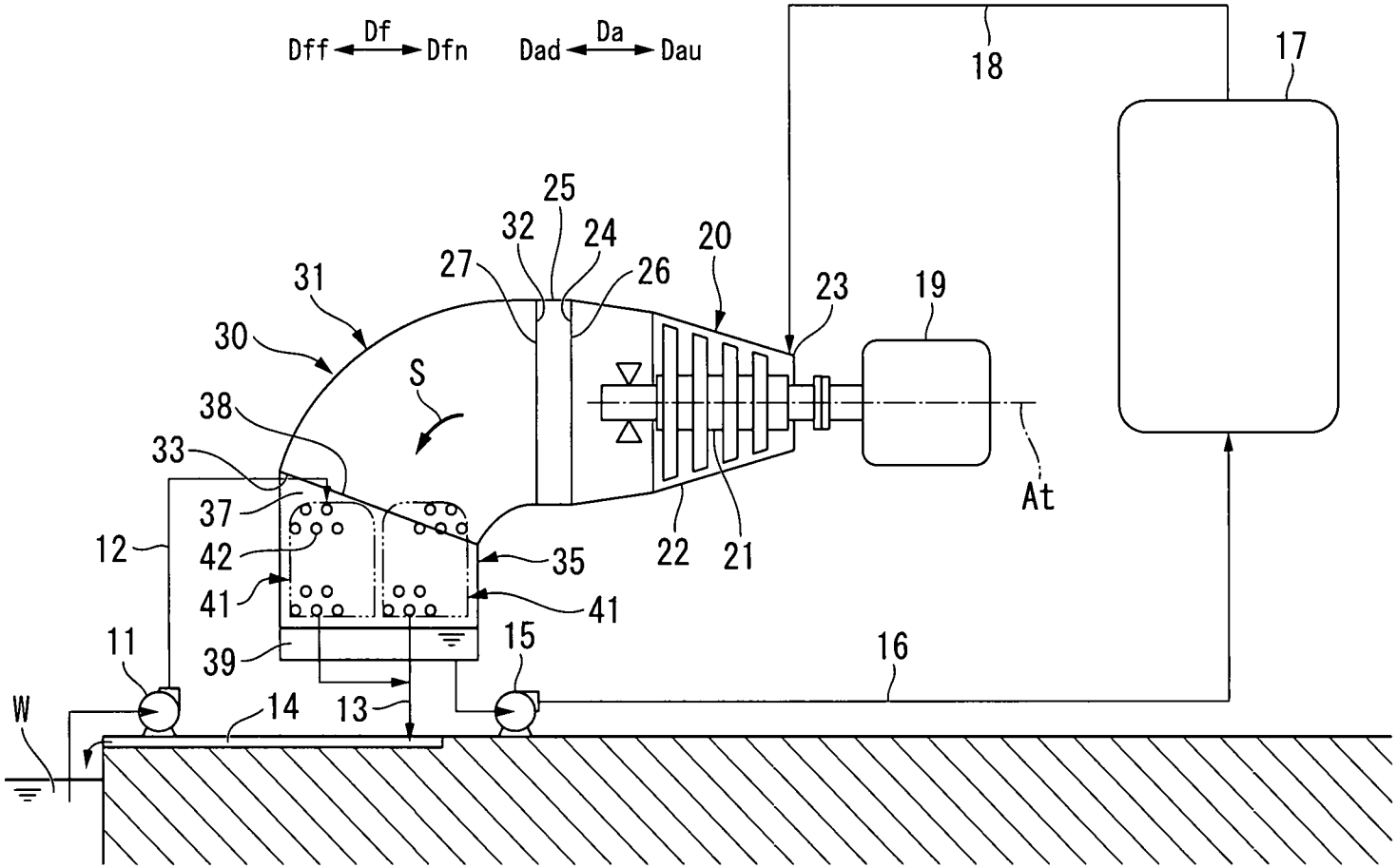
FIG. 1 is a system diagram of a steam turbine plant according to a first embodiment of the present invention.

As shown in FIG. 1, the steam turbine plant of the embodiment includes a steam generator 17 such as a boiler, a steam turbine 20 driven by steam generated in the steam generator 17, a generator 19 configured to generate power through driving of the steam turbine 20, a condenser 30 configured to condense steam S exhausted from the steam turbine 20, a water-feeding pump 15 configured to return water in the condenser 30 to the steam generator 17, and a cooling water pump 11 configured to supply cooling water for cooling steam to the condenser 30.

The steam generator 17 and the steam turbine 20 are connected by a main steam line 18. The steam generated in the steam generator 17 is supplied to the steam turbine 20 via the main steam line 18. The condenser 30 and the steam generator 17 are connected by a water-feeding line 16. The water-feeding pump 15 is installed on the water-feeding line 16. Water returned to liquid from the steam S in the condenser 30 is supplied to the steam generator 17 via the water-feeding line 16.

The steam turbine 20 has a rotor 21 that rotates about a turbine axis At, a main body casing 22 configured to cover the rotor 21, and an exhaust casing 25 configured to exhaust steam from the main body casing 22. The turbine axis At extends in a substantially horizontal direction. Further, hereinafter, a direction in which the turbine axis At extends is referred to as an axial direction Da, one side in the axial direction Da is referred to as an axial upstream side Dau, and the other side is referred to as an axial downstream side Dad.

The rotor 21 of the steam turbine 20 is connected to a rotor of the generator 19. The main body casing 22 and the exhaust casing 25 are formed in a tubular shape around the turbine axis At. A steam inlet 23 is formed on the axial upstream side Dau of the main body casing 22 having a tubular shape. In addition, a steam outlet 24 is formed on an end on the axial downstream side Dad of the main body casing 22. The steam outlet 24 opens toward the axial downstream side Dad from the inside of the main body casing 22. An exhaust steam inlet 26 is formed on an end on the axial upstream side Dau of the exhaust casing 25. The exhaust steam inlet 26 opens toward the axial upstream side Dau from the inside of the exhaust casing 25. The exhaust steam inlet 26 is connected to the steam outlet 24 of the main body casing 22. An exhaust steam outlet 27 is formed on an end on the axial downstream side Dad of the exhaust casing 25. The exhaust steam outlet 27 opens toward the axial downstream side Dad from the inside of the exhaust casing 25. Accordingly, the steam turbine 20 is an axial-flow exhaust type configured to exhaust the steam in the axial direction Da.

Figure 2:
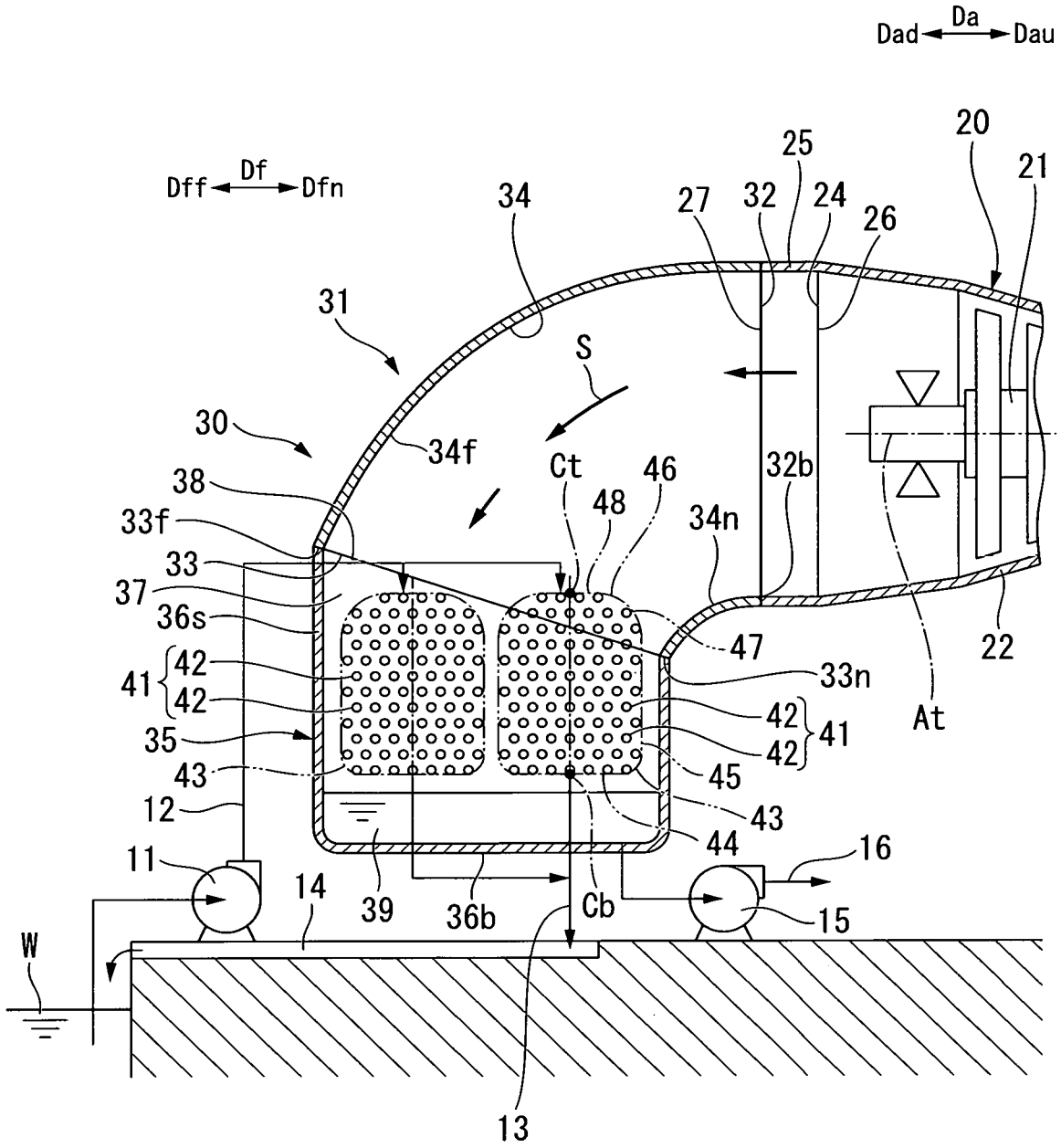
FIG. 2 is a schematic cross-sectional view of a steam turbine and a condenser according to the first embodiment of the present invention.

As shown in FIG. 2, the condenser 30 includes a plurality of heat transfer pipe groups 41, a main body 35 configured to cover the plurality of heat transfer pipe groups 41, and an intermediate body 31 configured to guide the steam S from the steam turbine 20 into the main body 35.

The intermediate body 31 has an intermediate body inlet 32 that opens in the horizontal direction from the inside and into which the steam S flows, an intermediate body outlet 33 that opens downward from the inside and configured to exhaust the steam S, and a flow path 34 configured to connect the intermediate body inlet 32 and the intermediate body outlet 33. The flow path 34 in the intermediate body 31 extends from the intermediate body inlet 32 in a far side-near side direction Df with respect to the intermediate body inlet 32 that is the horizontal direction, extends gradually downward as it extends away from the intermediate body inlet 32, and reaches the intermediate body outlet 33. The intermediate body inlet 32 is connected to the exhaust steam outlet 27 of the steam turbine 20. Accordingly, the far side-near side direction Df with respect to the intermediate body inlet 32 coincides with the axial direction Da of the steam turbine 20.

The main body 35 has a bottom plate **36*b*, and a side plate 36*s* extending upward from an edge of the bottom plate 36*b*. While not shown, the inside of the main body 35 is partitioned into a condensing chamber 37, a cooling water inlet chamber (not shown), and a cooling water outlet chamber (not shown). An upper section of the condensing chamber 37 opens. The opening forms a main body inlet 38. Accordingly, the main body inlet 38 opens upward from the condensing chamber 37. The main body inlet 38 is connected to the intermediate body outlet 33. A lower section in the condensing chamber 37 constitutes a hot well 39** in which the steam S condensed into liquid is accumulated.

The plurality of heat transfer pipe groups 41 are arranged in the horizontal direction and disposed in the condensing chamber 37. Among the plurality of heat transfer pipe groups 41, at least two of the heat transfer pipe groups 41 are arranged in the above-mentioned far side-near side direction Df.

Each of the plurality of heat transfer pipe groups 41 is constituted by a plurality of heat transfer pipes 42. Each of the heat transfer pipes 42 extends in the horizontal direction.

Here, a three-dimensional shape formed by virtual surfaces that circumscribe the plurality of heat transfer pipes 42 disposed on the outermost side among the plurality of heat transfer pipes 42 that constitute the heat transfer pipe group 41 is set as a pipe group outline 43. The pipe group outline 43 has a bottom surface 44 directed downward, a side surface 45 extending upward from an edge of the bottom surface 44, and an upper surface 46 directed upward. A dimension of the pipe group outline 43 in the vertical direction is larger than a dimension of the pipe group outline 43 in the horizontal direction. An upper section of the pipe group outline 43 including the upper surface 46 has a cross-sectional area in the horizontal direction that is gradually increased downward. Accordingly, the upper surface 46 has an inclined surface 47 gradually inclined downward as it approaches the side surface 45. In the embodiment, a position in the horizontal direction of a center Ct of a top surface 48 which is a collection of points at highest positions in the upper surface 46, and a position in the horizontal direction of a center Cb of the bottom surface 44 coincide with each other.

In addition, here, a side of the main body with reference to the intermediate body inlet in the far side-near side direction Df is referred to as a far side Dff, and a side of the intermediate body inlet with respect to the main body in the far side-near side direction Df is referred to as a near side Dfn.

A near-side outlet edge 33*n* that is an edge of the intermediate body outlet 33 on the near side Dfn in the far side-near side direction Df is disposed below the uppermost position among the plurality of heat transfer pipe groups 41. More specifically, the near-side outlet edge 33*n* is disposed in the vicinity of an intermediate position in the heat transfer pipe group 41 in the vertical direction. Meanwhile, a far-side outlet edge 33*f* that is an edge of the intermediate body outlet 33 on the far side Dff in the far side-near side direction Df is disposed above the uppermost position among the plurality of heat transfer pipe groups 41. For this reason, a position of the edge of the intermediate body outlet 33 is disposed gradually downward from the far-side outlet edge 33*f* toward the near side Dfn. Further, the uppermost position among the plurality of heat transfer pipe groups 41 is a position of the top surface 48 of the pipe group outline 43.

A near-side inner surface 34*n* that is an inner surface of the intermediate body 31 that forms the flow path 34 of the intermediate body 31 and including the near-side outlet edge 33*n* is a surface directed toward the near side Dfn in the far side-near side direction Df while being directed upward from the near-side outlet edge 33*n*. In addition, a far-side inner surface 34*f* that is an inner surface of the intermediate body 31 and including the far-side outlet edge 33*f* is a surface directed toward the near side Dfn in the far side-near side direction Df while being directed upward from the far-side outlet edge 33*f*.

The water-feeding line 16 is connected to the hot well 39 of the condenser 30. The cooling water pump 11 is connected to the heat transfer pipes 42 that constitute the plurality of heat transfer pipe groups 41 by a cooling water line 12 via the cooling water inlet chamber (not shown) in the main body 35. The cooling water pump 11 pumps up water from a water source W such as the sea or a river and supplies the water to the heat transfer pipes 42 that constitute the plurality of heat transfer pipe groups 41. The heat transfer pipes 42 that constitute the plurality of heat transfer pipe groups 41 are connected to a drain line 13 via the cooling water outlet chamber (not shown) in the main body 35. The drain line 13 extends to the inside of a drain pit 14 or directly to the water source W. The drain pit 14 extends to, for example, the above-mentioned water source W.

The steam generated in the steam generator 17 flows into the main body casing 22 of the steam turbine 20 via the main steam line 18. The steam rotates the rotor 21 while flowing through the main body casing 22. As a result, the rotor of the generator 19 rotates and the generator 19 generates power.

The steam flowing into the main body casing 22 is exhausted to the axial downstream side Dad from the exhaust steam outlet 27 of the exhaust casing 25 via the inside of the exhaust casing 25. The steam S exhausted from the steam turbine 20 flows into the intermediate body 31 of the condenser 30 from the intermediate body inlet 32. As described above, the exhaust steam outlet 27 of the steam turbine 20 opens from the inside of the exhaust casing 25 in the horizontal direction (the axial downstream side Dad). In addition, the intermediate body inlet 32 connected to the exhaust steam outlet 27 opens from the inside of the intermediate body 31 in the horizontal direction. Accordingly, a flow direction component of the steam S flowing into the intermediate body 31 has a large horizontal component. As the steam S flowing into the intermediate body 31 flows through the inside of the intermediate body 31 from the intermediate body inlet 32 toward the intermediate body outlet 33, the downward component in the direction component of the flow of the steam S increases gradually. In other words, as the steam S flowing into the intermediate body 31 flows through the inside of the intermediate body 31 from the intermediate body inlet 32 toward the intermediate body outlet 33, the flow is directed gradually downward.

The steam S passing through the intermediate body 31 flows into the condensing chamber 37 of the main body 35 from the main body inlet 38. The steam S flows mainly downward through the inside of the condensing chamber 37. The steam S exchanges heat with the cooling water flowing through the plurality of heat transfer pipes 42 that constitute each of the heat transfer pipe groups 41 while flowing through the condensing chamber 37.

The steam S is condensed through heat exchange with the cooling water flowing through the plurality of heat transfer pipes 42 that constitute each of the heat transfer pipe groups 41 and liquefied into water. The water is accumulated in the hot well 39 on a lower side in the condensing chamber 37. The water accumulated in the hot well 39 is returned to the steam generator 17 via the water-feeding line 16 and the water-feeding pump 15.

In the embodiment, the plurality of heat transfer pipe groups 41 are disposed to be arranged in the main body 35 in the horizontal direction. For this reason, in the embodiment, in comparison with the condenser in which the heat transfer pipe groups are disposed to be arranged in the vertical direction, a level difference between the heat transfer pipe 42 at the highest position and a water surface of the water source W can be relatively reduced. Accordingly, in the embodiment, a pumping head of the cooling water pump 11 can be decreased. For this reason, in the embodiment, installation cost and running cost of the cooling water pump 11 can be reduced.

When the position of the heat transfer pipe 42 is high, the cooling water flowing out of the heat transfer pipe 42 may boil under a reduced pressure in a process in which the cooling water reaches the water source W. For this reason, in this case, a method of raising a water level of the drain pit 14 between the heat transfer pipe group 41 and the water source W and reducing a level difference between the heat transfer pipes 42 at the highest position and the water surface of the drain pit 14 is adopted. In the embodiment, as described above, since a height of the heat transfer pipes 42 at the highest position can be lowered, installation cost of the drain pit 14 can be reduced.

Accordingly, in the embodiment, initial cost and running cost of the steam turbine plant can be reduced.

In addition, the pipe group outline 43 of the embodiment has a dimension in the horizontal direction that is smaller than a dimension in the vertical direction. Accordingly, in the embodiment, the bottom surface 44 of the pipe group outline 43 can be reduced. For this reason, in the embodiment, even when the plurality of heat transfer pipe groups 41 are disposed to be arranged in the main body 35 in the horizontal direction, an increase in occupation area of the condenser 30 can be minimized.

Further, an effect of the steam turbine plant of the embodiment will be described in comparison with a steam turbine plant of a comparative example with reference to FIG. 3.

Figure 3:
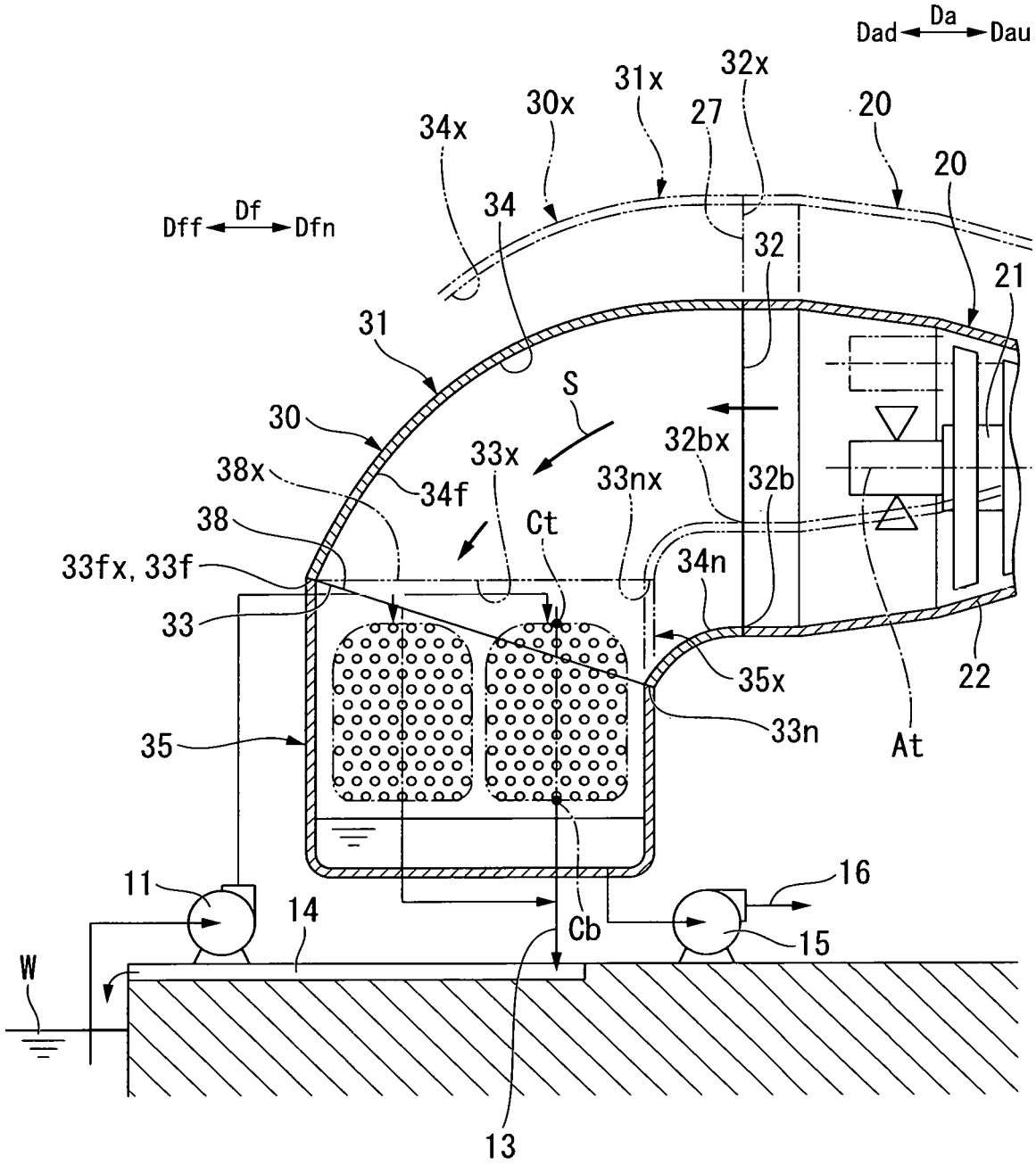
FIG. 3 is a view explaining a difference in configuration between the condenser according to the first embodiment of the present invention and a condenser of a comparative example.

The steam turbine plant of the comparative example also includes the steam turbine 20 and a condenser 30*x* configured to condense the steam exhausted from the steam turbine 20, both shown by two-dot chain lines in FIG. 3. The steam turbine 20 of the comparative example is the same as the steam turbine 20 of the embodiment. Meanwhile, the condenser 30*x* of the comparative example is different from the condenser 30 of the embodiment.

The condenser 30*x* of the comparative example also includes a plurality of heat transfer pipe groups 41, a main body 35*x* configured to cover the plurality of heat transfer pipe groups 41, and an intermediate body 31*x* configured to guide the steam S from the steam turbine 20 into the main body 35*x*.

The intermediate body 31*x* has an intermediate body inlet 32*x* that opens in the horizontal direction from the inside and into which the steam S flows, an intermediate body outlet 33*x* that opens downward from the inside and through which the steam S is exhausted, and a flow path 34*x* configured to connect the intermediate body inlet 32*x* and the intermediate body outlet 33*x*. The flow path 34*x* in the intermediate body 31*x* extends from the intermediate body inlet 32*x* in the far side-near side direction Df with respect to the intermediate body inlet 32*x* that is the horizontal direction, extends gradually downward as it extends away from the intermediate body inlet 32*x*, and reaches the intermediate body outlet 33*x*. The intermediate body inlet 32*x* is connected to the exhaust steam outlet 27 of the steam turbine 20. The intermediate body outlet 33*x* is connected to a main body inlet 38*x* of the main body 35*x*. The above-mentioned configuration related to the intermediate body 31*x* of the comparative example is the same as the configuration of the intermediate body 31 of the embodiment.

However, in the comparative example, a near-side outlet edge 33*nx* that is an edge of the intermediate body outlet 33*x* on the near side Dfn in the far side-near side direction Df and a far-side outlet edge 33*fx* that is an edge of the intermediate body outlet 33*x* on the far side Dff in the far side-near side direction Df are disposed at the same position in the vertical direction. Moreover, in the comparative example, the entire edge of the intermediate body outlet 33*x* is disposed above the uppermost position among the plurality of heat transfer pipe groups 41. Further, the far-side outlet edge 33*fx* of the comparative example and the far-side outlet edge 33*f* of the embodiment are disposed at the same position in the vertical direction.

Suppose that a distance in the vertical direction from a lower end 32*bx* of the intermediate body inlet 32*x* to the near-side outlet edge 33*nx* of the intermediate body outlet 33*x* in the comparative example is equal to a distance in the vertical direction from a lower end 32*b* of the intermediate body inlet 32 to the near-side outlet edge 33*n* of the intermediate body outlet 33 in the embodiment. In this case, since the near-side outlet edge 33*n* of the embodiment is disposed below the near-side outlet edge 33*nx* of the comparative example in the vertical direction, the lower end 32*b* of the intermediate body inlet 32 of the embodiment is disposed below the lower end 32*bx* of the intermediate body inlet 32*x* of the comparative example.

Accordingly, the steam turbine 20 connected to the intermediate body inlet 32 in the embodiment is disposed below the steam turbine 20 connected to the intermediate body inlet 32*x* in the comparative example. For this reason, installation cost of the steam turbine 20 in the embodiment can be made lower than that of the comparative example. Accordingly, in the embodiment, also from this viewpoint, initial cost of the steam turbine plant can be reduced.

In addition, in the embodiment, the position of the edge of the intermediate body outlet 33 is disposed gradually downward from the far-side outlet edge 33*f* toward the near side Dfn. In other words, in the embodiment, the edge of the intermediate body outlet 33 is inclined from the far-side outlet edge 33*f* toward the near-side outlet edge 33*n*. Accordingly, in the embodiment, an opening area of the intermediate body outlet 33 can be increased. In addition, in the embodiment, the near-side outlet edge 33*n* of the intermediate body outlet 33 is disposed below the uppermost position among the plurality of heat transfer pipe groups 41, and the near-side inner surface 34*n* of the intermediate body 31 is directed toward the near side Dfn in the far side-near side direction Df while being directed upward from the near-side outlet edge 33*n*. For this reason, in the embodiment, the steam flows from the lateral side as well as from the upper side into the heat transfer pipe group 41 farthest on the near side Dfn among the plurality of heat transfer pipe groups 41. In other words, in the embodiment, a flow path area of the flow path on the side of the intermediate body outlet 33 in the flow path 34 in the intermediate body 31 is increased. As a result, in the embodiment, an average flow speed of the steam flowing into the heat transfer pipe groups 41 can be made lower than that of the comparative example, and it is considered that a certain effect on suppression of erosion in the heat transfer pipes 42 is provided.

Second Embodiment

Figure 4:
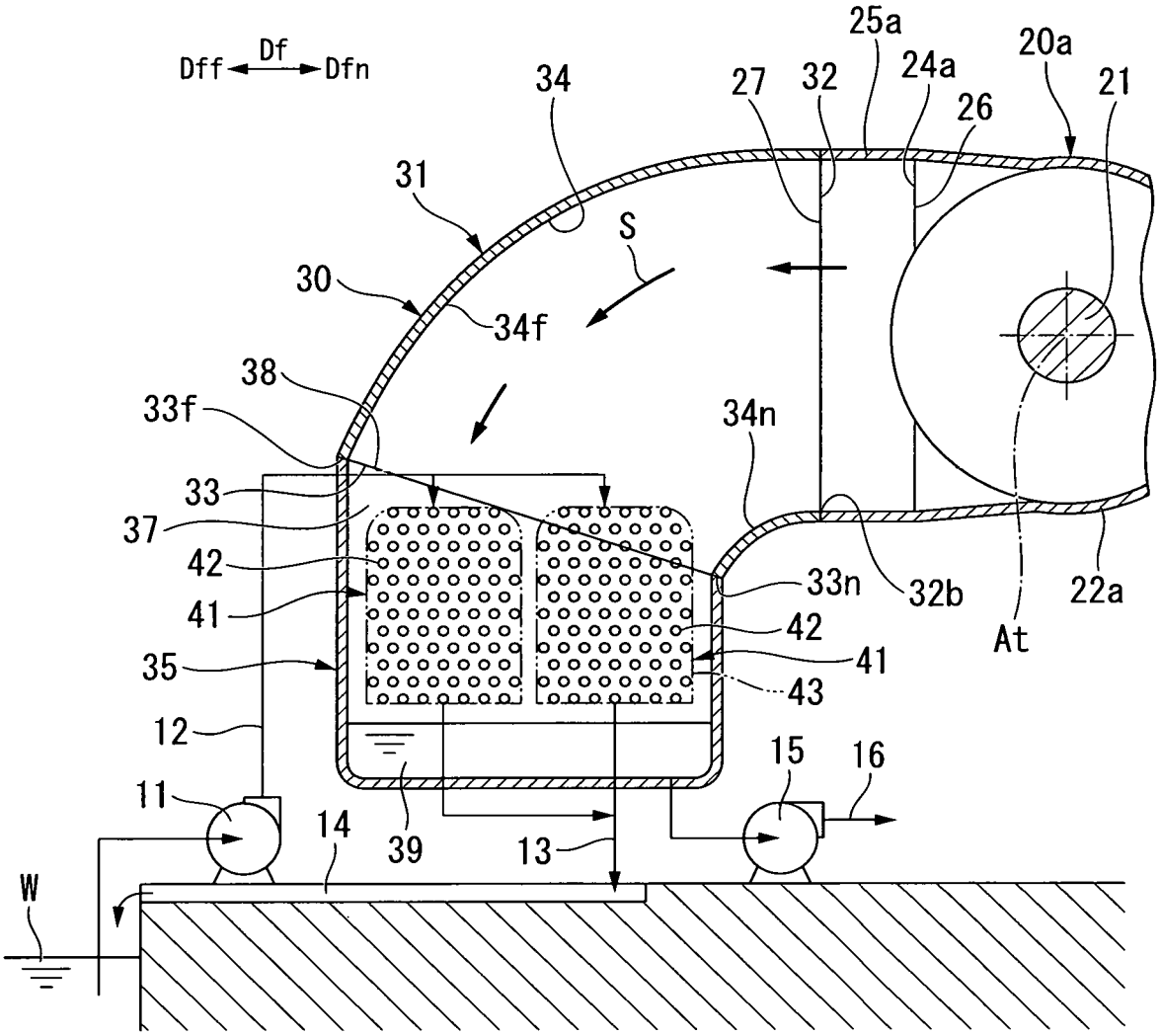
FIG. 4 is a schematic cross-sectional view of a steam turbine and a condenser according to a second embodiment of the present invention.

A second embodiment of the steam turbine plant according to the present invention will be described with reference to FIG. 4.

The steam turbine plant of the embodiment includes, like the steam turbine plant of the first embodiment, a steam turbine 20*a* and a condenser 30.

The steam turbine 20*a* of the embodiment also has, like the steam turbine 20 of the first embodiment, the rotor 21 that rotates about the turbine axis At, a main body casing 22*a* configured to cover the rotor 21, and an exhaust casing 25*a* configured to exhaust steam from the inside of the main body casing 22*a*. The main body casing 22*a* is formed in a tubular shape around the turbine axis At. A steam inlet (not shown) is formed axially upstream from the main body casing 22*a* having a tubular shape. A steam outlet 24*a* is formed axially downstream from the main body casing 22*a* having a tubular shape. However, unlike the steam outlet 24 of the first embodiment, the steam outlet 24*a* opens sideways from the inside of the main body casing 22*a*.

The exhaust casing 25*a* is formed in a tubular shape about an axis that is perpendicular to the turbine axis At and oriented in the horizontal direction. The exhaust steam inlet 26 is formed on one end of the exhaust casing 25*a* in the axial direction. In addition, the exhaust steam outlet 27 is formed on the other end of the exhaust casing 25*a* in the axial direction. Both of the exhaust steam inlet 26 and the exhaust steam outlet 27 open from the inside of the exhaust casing 25*a* in the horizontal direction. The exhaust steam inlet 26 is connected to the steam outlet 24*a* of the main body casing 22*a*.

Accordingly, the steam turbine 20*a* of the embodiment is a lateral exhaust type steam turbine configured to exhaust steam sideways perpendicular to the turbine axis At.

The condenser 30 of the embodiment includes, like the condenser 30 of the first embodiment, the plurality of heat transfer pipe groups 41, the main body 35 configured to cover the plurality of heat transfer pipe groups 41, and the intermediate body 31 configured to guide the steam S from the steam turbine 20*a* into the main body 35. The plurality of heat transfer pipe groups 41, the main body 35 and the intermediate body 31 of the embodiment are basically the same as the plurality of heat transfer pipe groups 41, the main body 35 and the intermediate body 31 of the first embodiment, respectively. Accordingly, the intermediate body 31 of the embodiment also has the intermediate body inlet 32 that opens from the inside in the horizontal direction and into which the steam S flows, the intermediate body outlet 33 that opens downward from the inside and through which the steam S is exhausted, and the flow path 34 configured to connect the intermediate body inlet 32 and the intermediate body outlet 33. The flow path 34 in the intermediate body 31 extends from the intermediate body inlet 32 in the far side-near side direction Df with respect to the intermediate body inlet 32 that is the horizontal direction, extends downward as it extends away from the intermediate body inlet 32, and reaches the intermediate body outlet 33. The intermediate body inlet 32 is connected to the exhaust steam outlet 27 of the steam turbine 20*a*. Accordingly, unlike in the first embodiment, the far side-near side direction Df with respect to the intermediate body inlet 32 is a horizontal direction perpendicular to the turbine axis At.

As described above, the condenser 30 of the embodiment is also the same as the condenser 30 of the first embodiment. Accordingly, also in the embodiment, initial cost and running cost of the steam turbine plant can be reduced.

In addition, also in the embodiment, the pipe group outline 43 has a dimension in the horizontal direction that is smaller than a dimension in the vertical direction. Accordingly, also in the embodiment, an increase in occupation area of the condenser 30 can be minimized.

That is, also when the steam turbine 20*a* is a lateral exhaust type, since the condenser 30 having the same structure as the first embodiment is employed, the same effect as in the first embodiment can be obtained.

[First Variant]

Figure 5:
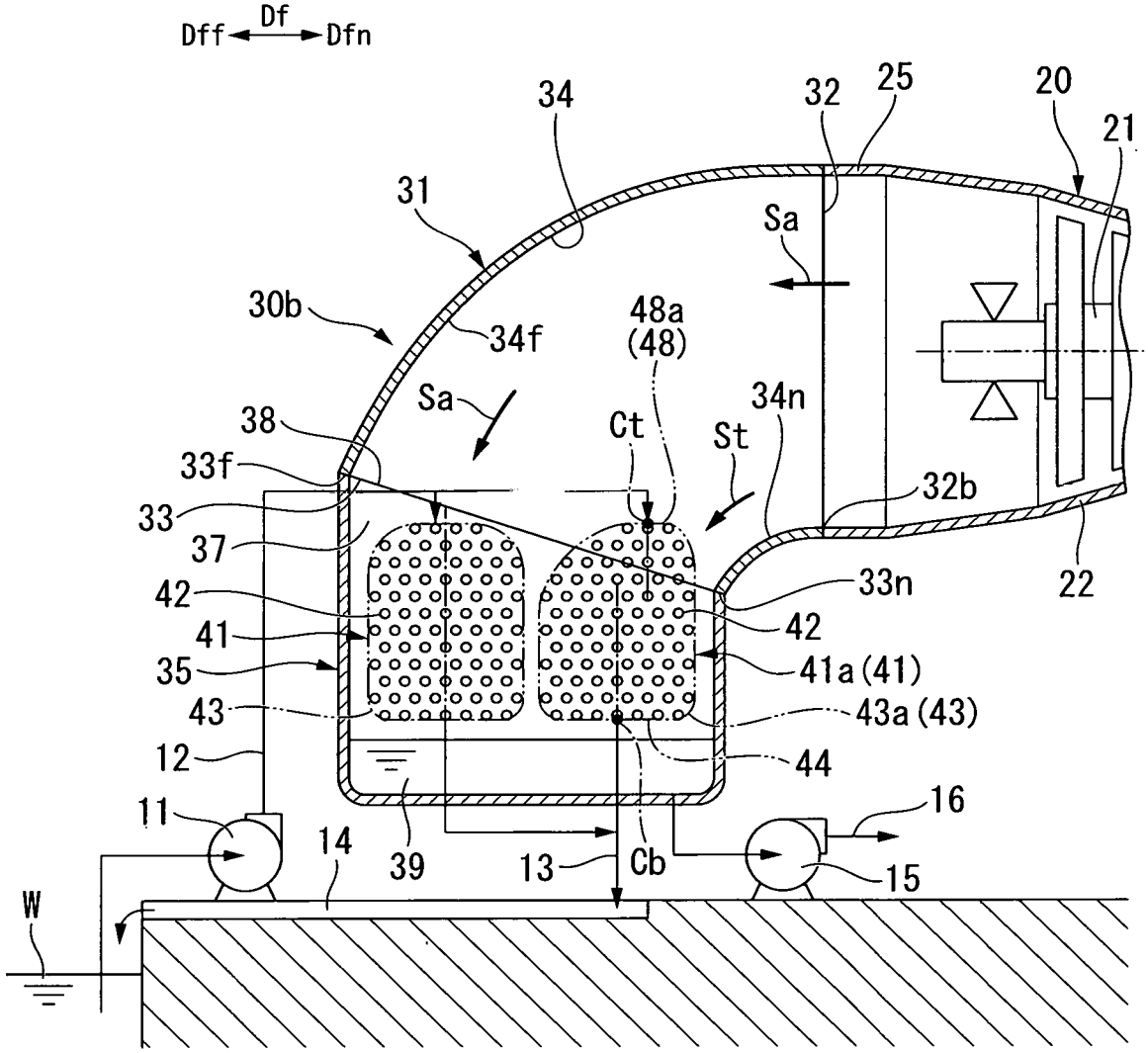
FIG. 5 is a schematic cross-sectional view of a condenser according to a first variant of the present invention.

A first variant of the condenser 30 according to the first embodiment will be described with reference to FIG. 5.

In a condenser 30*b* of the variant, a pipe group outline 43*a* of a heat transfer pipe group 41*a* disposed farthest on the near side Dfn in the far side-near side direction Df with respect to the intermediate body inlet 32 among the plurality of heat transfer pipe groups 41 is changed. In the variant, the center Ct of a top surface 48*a* in the pipe group outline 43*a* of the heat transfer pipe group 41*a* on the near side Dfn is disposed closer to the near side Dfn than the center Cb of the bottom surface 44 in the pipe group outline 43*a*. Accordingly, the pipe group outline 43*a* has an eccentric outline.

Most of steam Sa flowing into the intermediate body 31 from an upper part in the opening of the intermediate body inlet 32 flows into the main body 35 from a part on the far side Dff in the opening of the main body inlet 38. Meanwhile, most of steam St flowing into the intermediate body 31 from a lower part in the opening of the intermediate body inlet 32 flows into the main body 35 from a part on the near side Dfn in the opening of the main body inlet 38. Accordingly, a distance in the vertical direction from the intermediate body inlet 32 to the main body inlet 38 for the most of the steam St flowing into the main body 35 from the part on the near side Dfn is smaller than that for the steam Sa flowing into the main body 35 from the part on the far side Dff. For this reason, a downward component in the flow direction component of the steam S is smaller in the steam St flowing into the main body 35 from the part on the near side Dfn than in the steam Sa flowing into the main body 35 from the part on the far side Dff. In other words, a horizontal component in the flow direction component of the steam S is larger in the steam St flowing into the main body 35 from the part on the near side Dfn than in the steam Sa flowing into the main body 35 from the part on the far side Dff.

In addition, among the plurality of heat transfer pipe groups 41, the heat transfer pipe group 41*a* disposed on the near side Dfn has a larger contact quantity with the steam Sa flowing into the main body 35 from the part on the near side Dfn than with the steam St flowing into the main body 35 from the part on the far side Dff.

Here, in the variant, since the pipe group outline 43*a* of the heat transfer pipe group 41*a* disposed on the near side Dfn has an eccentric outline as described above, efficiency of heat exchange between the cooling water in the heat transfer pipes 42 that constitute the heat transfer pipe group 41*a* and the steam S is increased.

Further, while the variant is the variant of the first embodiment, the heat transfer pipe group 41 on the near side Dfn of the second embodiment may have the same configuration as in the variant.

[Second Variant]

Figure 6:
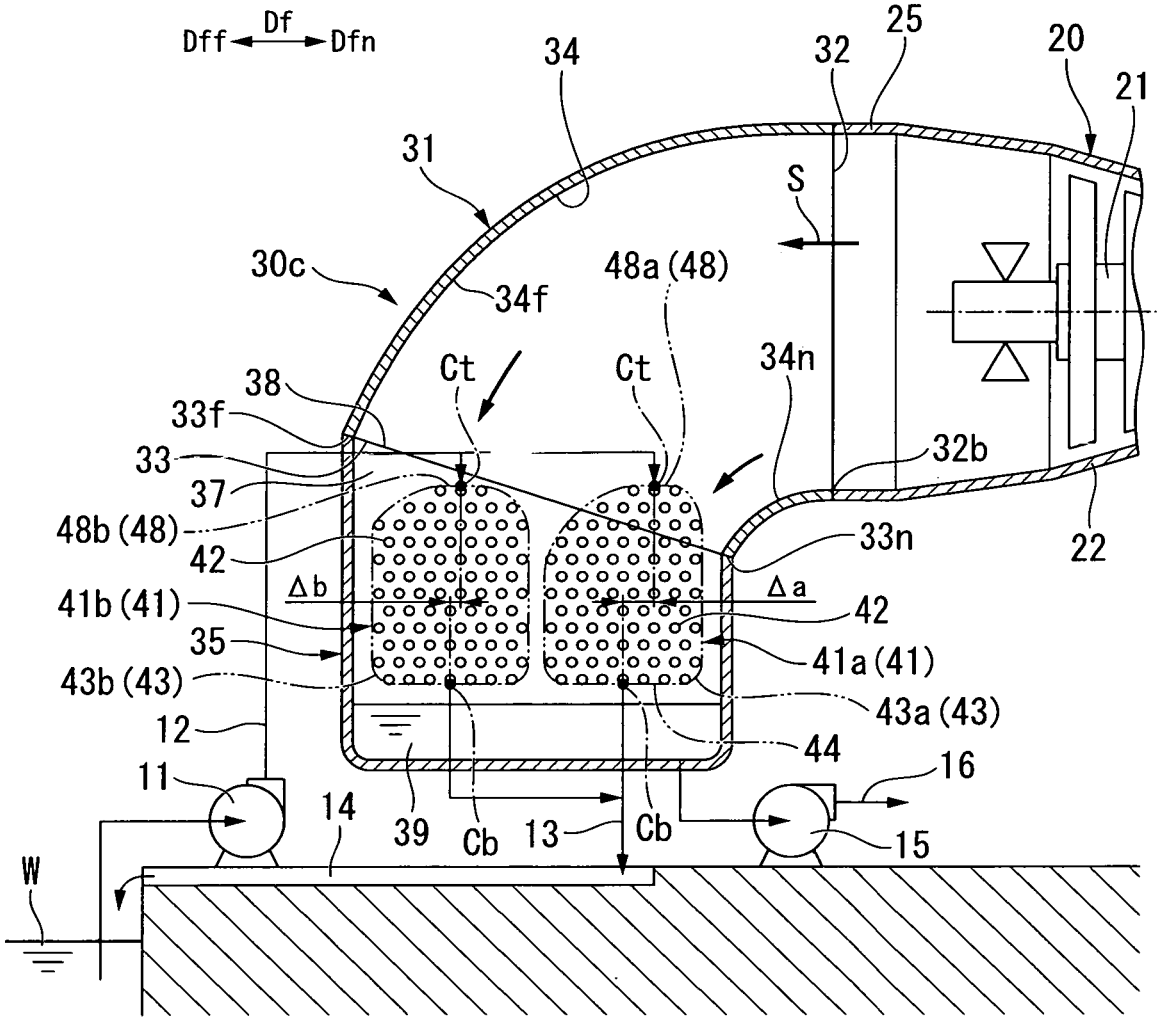
FIG. 6 is a schematic cross-sectional view of a condenser according to a second variant of the present invention.

A second variant of the condenser 30 according to the first embodiment will be described with reference to FIG. 6.

In the condenser 30*b* of the first variant, among the plurality of heat transfer pipe groups 41, only the heat transfer pipe group 41*a* farthest on the near side Dfn has an eccentric outline. However, like in a condenser 30*c* of the variant, a heat transfer pipe group 41*b* on the far side Dff may also have an eccentric outline.

Here, a distance in the far side-near side direction Df from the center Cb of the bottom surface 44 in the pipe group outline 43*a* of the heat transfer pipe group 41*a* on the near side Dfn to the center Ct of the top surface 48*a* of the pipe group outline 43*a* is set as an eccentric amount Δa. In addition, a distance in the far side-near side direction Df from the center Cb of the bottom surface 44 in a pipe group outline 43*b* of the heat transfer pipe group 41*b* on the far side Dff to the center Ct of a top surface 48*b* of the pipe group outline 43*b* is set as an eccentric amount Δb.

When the heat transfer pipe group 41*b* on the far side Dff also has an eccentric outline as in the variant, the eccentric amount Δb in the pipe group outline 43*b* of the heat transfer pipe group 41*b* is preferably smaller than the eccentric amount Δa in the pipe group outline 43*a* of the heat transfer pipe group 41*a* on the near side Dfn. In other words, the eccentric amount Δa in the pipe group outline 43*a* of the heat transfer pipe group 41*a* on the near side Dfn is preferably larger than the eccentric amount Δb in the pipe group outline 43*b* of the heat transfer pipe group 41*b* on the far side Dff.

Further, while the variant is the variant of the first embodiment, the plurality of heat transfer pipe groups 41 of the second embodiment may have the same configuration as in the variant.

[Third Variant]

Figure 7:
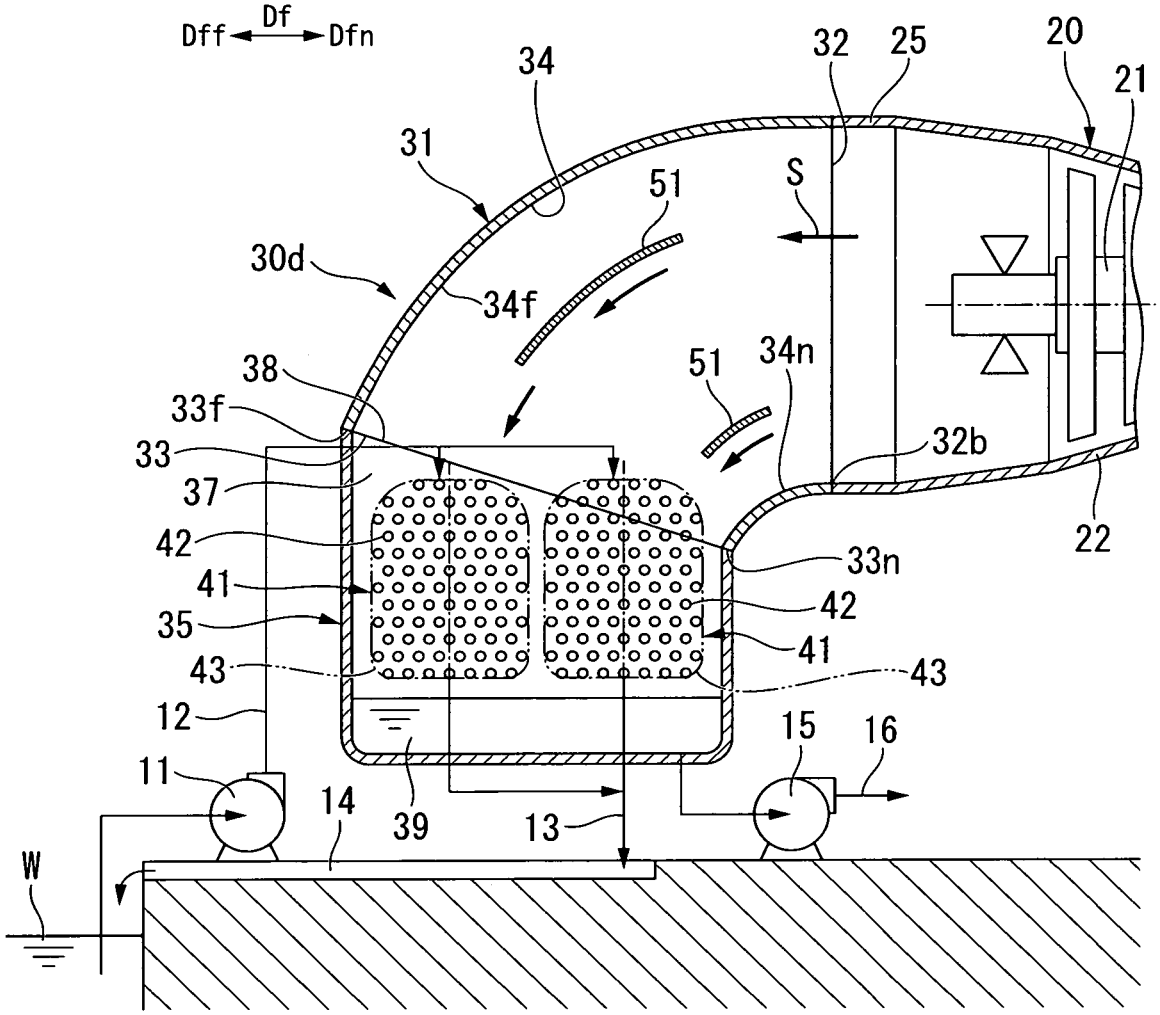
FIG. 7 is a schematic cross-sectional view of a condenser according to a third variant of the present invention.

A third variant of the condenser 30 according to the first embodiment will be described with reference to FIG. 7.

A condenser 30*d* of the variant includes a steam guide 51 disposed in the intermediate body 31 and configured to cause a direction of a flow of the steam S flowing in from the intermediate body inlet 32 to be directed gradually downward. The steam guide 51 is curved gradually downward as it extends toward the far side Dff in the far side-near side direction Df.

Accordingly, in the variant, a downward component in the flow direction component of the steam S flowing into the main body 35 from the main body inlet 38 can be made larger than the same component in the first embodiment. For this reason, in the variant, efficiency of heat exchange between the cooling water in the heat transfer pipes 42 that constitute each of the heat transfer pipe groups 41 and the steam S can be increased.

Further, while the variant is the variant of the first embodiment, the condenser of the second embodiment may also have the same configuration as in the variant.

[Fourth Variant]

Figure 8:
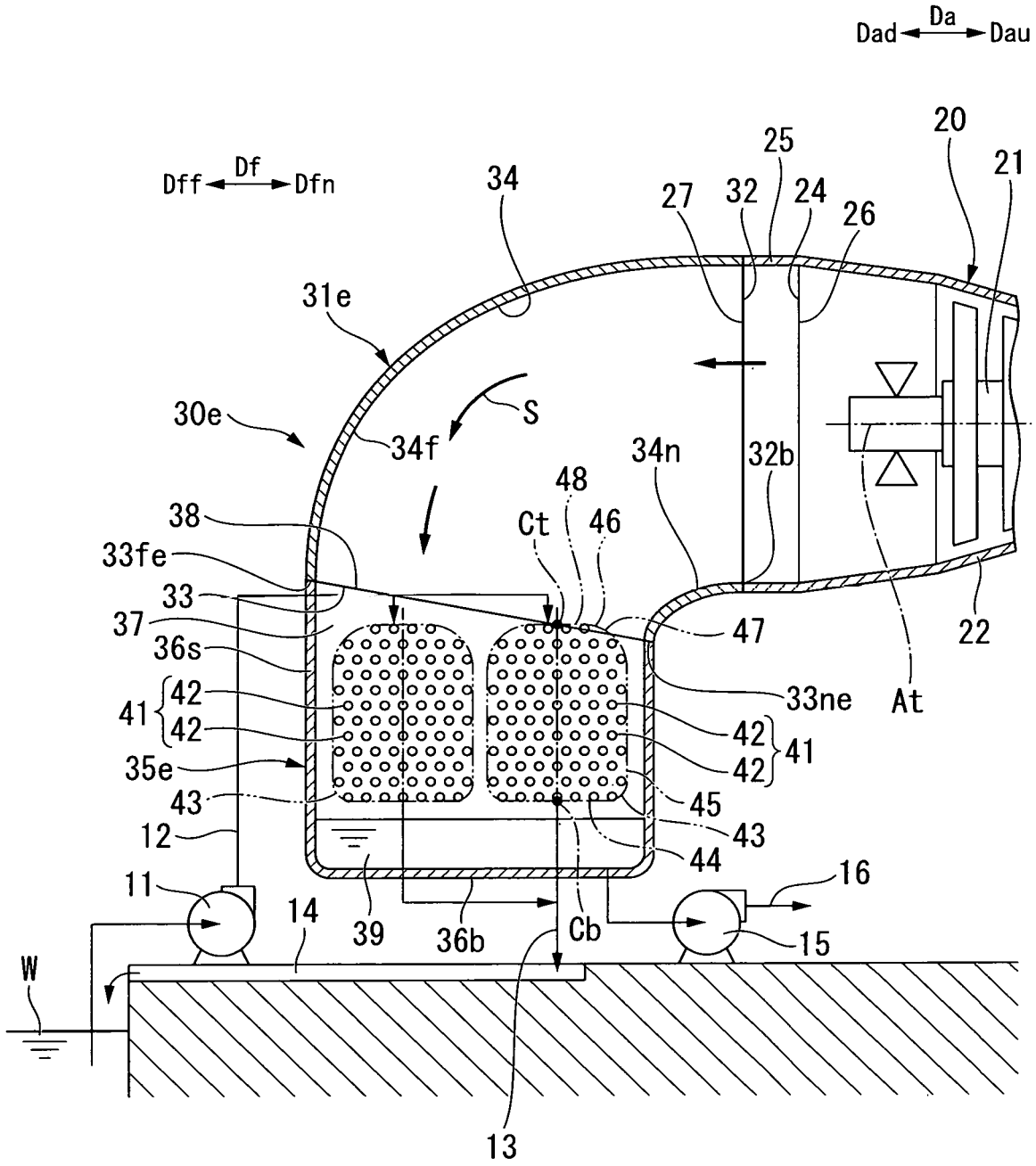
FIG. 8 is a schematic cross-sectional view of a condenser according to a fourth variant of the present invention.

A fourth variant of the condenser 30 according to the first embodiment will be described with reference to FIG. 8.

In the first embodiment, the uppermost position among the plurality of heat transfer pipe groups 41 is above the lower end 32*b* of the intermediate body inlet 32. Meanwhile, in a condenser 30*e* of the variant, the uppermost position among the plurality of heat transfer pipe groups 41 is below the lower end 32*b* of the intermediate body inlet 32. In other words, the plurality of heat transfer pipe groups 41 are disposed at positions below the lower end 32*b* of the intermediate body inlet 32.

In the variant, to realize the above-mentioned disposition of the plurality of heat transfer pipe groups 41, a position of a near-side outlet edge 33*ne* of the intermediate body outlet 33 in an intermediate body 31*e* is set to be higher than a position of the near-side outlet edge 33*n* of the intermediate body outlet 33 of the first embodiment. In relation to this, a shape of a main body 35*e* of the variant is also slightly different from a shape of the main body 35 of the first embodiment. Further, together with this, an installation position of the steam turbine 20 is raised. Further, in the variant, a position of a far-side outlet edge 33*fe* of the intermediate body outlet 33 is the same as the position of the far-side outlet edge 33*f* of the intermediate body outlet 33 of the first embodiment in the vertical direction.

Thus, in the variant, since the plurality of heat transfer pipe groups 41 are disposed at positions below the lower end 32*b* of the intermediate body inlet 32, it is considered that the steam that flows straight from the steam turbine 20 in the horizontal direction does not directly flow into the heat transfer pipe groups 41, and that occurrence of erosion in the heat transfer pipes 42 can be reduced to a lower level than in the first embodiment. However, in the variant, as described above, an installation position of the steam turbine 20 is raised. Accordingly, whether to set the uppermost position among the plurality of heat transfer pipe groups 41 to be above or below the lower end 32*b* of the intermediate body inlet 32 should be determined according to which of reducing the occurrence of erosion in the heat transfer pipes 42 and lowering the installation position of the steam turbine 20 is given more emphasis.

Incidentally, a gas turbine combined cycle plant includes a steam turbine plant provided with a steam turbine and a condenser. Accordingly, the present invention may also be applied to the condenser of a gas turbine combined cycle plant.

INDUSTRIAL APPLICABILITY

According to an aspect of the present invention, initial cost and running cost of a steam turbine plant can be reduced.

REFERENCE SIGNS LIST

11 Cooling water pump
12 Cooling water line
13 Drain line
14 Drain pit
15 Water-feeding pump
16 Water-feeding line
17 Steam generator
18 Main steam line
19 Generator
20, 20*a* Steam turbine
21 Rotor
22, 22*a* Main body casing
23 Steam inlet
24, 24*a* Steam outlet
25, 25*a* Exhaust casing
26 Exhaust steam inlet
27 Exhaust steam outlet
30, 30*a*, 30*b*, 30*c*, 30*d*, 30*e* Condenser
31, 31*e* Intermediate body
32 Intermediate body inlet
32*b* Lower end
33 Intermediate body outlet
33*f*, 33*fe* Far-side outlet edge
33*n*, 33*ne* Near-side outlet edge
34 Flow path
34*f* Far-side inner surface
34*n* Near-side inner surface
35, 35*e* Main body
36*b* Bottom plate
36*s* Side plate
37 Condensing chamber
38 Main body inlet
39 Hot well
41, 41*a*, 41*b* Heat transfer pipe group
42 Heat transfer pipe
43, 43*a*, 43*b* Pipe group outline
44 Bottom surface
45 Side surface
46 Upper surface
47 Inclined surface
48, 48*a*, 48*b* Top surface
51 Steam guide
At Turbine axis
Da Axial direction
Dad Axial downstream side
Dau Axial upstream side
Df Far side-near side direction
Dff Far side
Dfn Near side
S Steam
W Water source

The invention claimed is:

1. A condenser comprising:

a plurality of heat transfer pipe groups constituted by a plurality of heat transfer pipes through which cooling water that exchanges heat with steam passes;

a main body configured to cover the plurality of heat transfer pipe groups; and an intermediate body connected to the main body and configured to guide steam into the main body, wherein the intermediate body has an intermediate body inlet that opens from the inside in a horizontal direction and into which steam flows, an intermediate body outlet that opens downward from the inside and through which steam is exhausted, and a flow path configured to connect the intermediate body inlet and the intermediate body outlet and cause the steam flowing in from the intermediate body inlet to be directed gradually downward as the steam flows away from the intermediate body inlet in the horizontal direction to reach the intermediate body outlet, the main body has a main body inlet that opens upward from the inside and is connected to the intermediate body outlet, and into which the steam from the intermediate body flows, the plurality of heat transfer pipe groups are arranged in the horizontal direction and disposed in the main body, a near-side outlet edge that is an edge of the intermediate body outlet on a side near the intermediate body inlet in the horizontal direction is disposed below an uppermost position among the plurality of heat transfer pipe groups, among the plurality of the heat transfer pipe groups, at least one part of the main body disposed at a far side from a center position in a far side-near side direction is located below an imaginary line, and at least one part of the main body disposed at a near side from a center position in the far side-near side direction is located above the imaginary line, the far side is an opposite side to the near side in a horizontal direction, the imaginary line is a line which connects the near-side outlet edge and a far-side outlet edge that is an edge of the intermediate body outlet on a side far from the intermediate body inlet, and the far side-near side direction is on a horizontal direction and the far side and the near side are defined with respect to the intermediate body inlet.

2. The condenser according to claim 1, wherein a near-side inner surface including the near-side outlet edge that is an inner surface of the intermediate body that forms the flow path of the intermediate body is a surface directed toward a side near the intermediate body inlet while being directed upward from the near-side outlet edge.

3. The condenser according to claim 1, wherein the far-side outlet edge is disposed above the uppermost position among the plurality of heat transfer pipe groups.

4. The condenser according to claim 1, wherein the plurality of heat transfer pipe groups are disposed at positions below a lower end of the intermediate body inlet in the main body.

5. The condenser according to claim 1, wherein a dimension in a vertical direction of a pipe group outline formed by virtual surfaces that circumscribe the plurality of heat transfer pipes disposed on the outermost side among the plurality of heat transfer pipes that constitute the heat transfer pipe group is larger than a dimension of the pipe group outline in the horizontal direction.

6. The condenser according to claim 5, wherein the pipe group outline has an upper surface directed upward and a bottom surface directed downward, and an upper section including the upper surface in the pipe group outline has a cross-sectional area in the horizontal direction that is gradually increased downward.

7. The condenser according to claim 6, wherein the pipe group outline of at least one of the heat transfer pipe groups is an eccentric outline in which a center of a top surface at the uppermost position in the upper surface is disposed closer to the intermediate body inlet in the horizontal direction than a center of the bottom surface in a same pipe group outline.

8. The condenser according to claim 7, wherein the plurality of heat transfer pipe groups are arranged in a far side-near side direction, that is the horizontal direction, with respect to the intermediate body inlet and the pipe group outline of any one of the heat transfer pipe groups which is the closest to the intermediate body inlet in the far side-near side direction among the plurality of heat transfer pipe groups is the eccentric outline.

9. The condenser according to claim 5, further comprising a steam guide disposed in the intermediate body and causing a direction of a flow of the steam flowing in from the intermediate body inlet to be directed gradually downward.

10. A steam turbine plant comprising:

a condenser, wherein the condenser comprising: a plurality of heat transfer pipe groups constituted by a plurality of heat transfer pipes through which cooling water that exchanges heat with steam passes; a main body configured to cover the plurality of heat transfer pipe groups; and an intermediate body connected to the main body and configured to guide steam into the main body, wherein the intermediate body has an intermediate body inlet that opens from the inside in a horizontal direction and into which steam flows, an intermediate body outlet that opens downward from the inside and through which steam is exhausted, and a flow path configured to connect the intermediate body inlet and the intermediate body outlet and cause the steam flowing in from the intermediate body inlet to be directed gradually downward as the steam flows away from the intermediate body inlet in the horizontal direction to reach the intermediate body outlet, the main body has a main body inlet that opens upward from the inside and is connected to the intermediate body outlet, and into which the steam from the intermediate body flows, the plurality of heat transfer pipe groups are arranged in the horizontal direction and disposed in the main body, and a near-side outlet edge that is an edge of the intermediate body outlet on a side near the intermediate body inlet in the horizontal direction is disposed below an uppermost position among the plurality of heat transfer pipe groups, among the plurality of the heat transfer pipe groups, at least one part of the main body disposed at a far side from a center position in a far side-near side direction is located below an imaginary line, and at least one part of the main body disposed at a near side from a center position in the far side-near side direction is located above the imaginary line, the far side is an opposite side to the near side in a horizontal direction, the imaginary line is a line which connects the near-side outlet edge and a far-side outlet edge that is an edge of the intermediate body outlet on a side far from the intermediate body inlet, and the far side-near side direction is on a horizontal direction and the far side and the near side are defined with respect to the intermediate body inlet; and a steam turbine configured to exhaust the steam into the condenser.

11. The steam turbine plant according to claim 10, wherein the steam turbine is an axial-flow exhaust type steam turbine.

12. The steam turbine plant according to claim 10, wherein the steam turbine is a lateral exhaust type steam turbine.

* * * * *